US009622606B1

(12) United States Patent
Rotello et al.

(10) Patent No.: US 9,622,606 B1
(45) Date of Patent: Apr. 18, 2017

(54) CLOSET ORGANIZING DEVICE

(71) Applicants: Leo Rotello, Rockville, MD (US); Lisa Rotello, Rockville, MD (US)

(72) Inventors: Leo Rotello, Rockville, MD (US); Lisa Rotello, Rockville, MD (US)

( * ) Notice: Subject to any disclaimer, the term of this patent is extended or adjusted under 35 U.S.C. 154(b) by 0 days.

(21) Appl. No.: 15/245,990

(22) Filed: Aug. 24, 2016

(51) Int. Cl.
*A47G 25/14* (2006.01)
*G09F 3/00* (2006.01)
*G09F 3/02* (2006.01)

(52) U.S. Cl.
CPC ..... *A47G 25/1428* (2013.01); *G09F 3/00* (2013.01); *G09F 3/0295* (2013.01); *G09F 2003/0282* (2013.01)

(58) Field of Classification Search
CPC ..... A47G 25/1428
See application file for complete search history.

(56) References Cited

U.S. PATENT DOCUMENTS 1,544,844 A * 7/1925 Levkowits ..... A47G 25/1428 40/5
1,575,775 A * 3/1926 Lesser ..... A47G 25/1428 223/92
2,166,492 A * 7/1939 Harvey ..... A47G 25/4023 223/94
3,535,808 A * 10/1970 Morrish ..... A47G 25/1428 223/92
4,137,661 A * 2/1979 Johansson ..... G09F 3/04 40/322
4,333,590 A 6/1982 Princiotta
5,056,248 A 10/1991 Blanchard
5,381,938 A 1/1995 Vasudeva
5,499,466 A * 3/1996 House ..... A47G 25/1428 40/322
D393,371 S 4/1998 Dunn
7,552,849 B2 6/2009 Gouldson
D648,142 S * 11/2011 Ferraro ..... D6/328
8,113,394 B2 2/2012 Ho
8,857,677 B2 10/2014 Gouldson
(Continued)

FOREIGN PATENT DOCUMENTS

DE 9109953.6 9/1992
GB 2140679 A 12/1984
(Continued)

*Primary Examiner* — Gary C Hoge
(74) *Attorney, Agent, or Firm* — Edell, Shapiro & Finnan LLC; Richard C. Irving

(57) ABSTRACT

A closet organizing device includes a base, first and second stabilizers, and a tabular portion. The base has upper and lower ends and a hole formed therein extending through a central portion of the upper and lower ends for receiving a hook portion of a clothing hanger. The first and second stabilizers extend from the lower end and are substantially perpendicular to the lower end and are equidistant from and on opposite sides of the hole. The first and second stabilizers are configured to fit over opposite sides of a hanger body. An edge portion extends along an outer surface of the base between the upper and lower ends. A tabular portion extends outwardly from the edge portion, has parallel front and rear sides, and resides in a plane that is substantially aligned with a lengthwise direction of the hole.

16 Claims, 4 Drawing Sheets

(56) References Cited

U.S. PATENT DOCUMENTS

| | | | | |
|---|---|---|---|---|
| 2006/0208012 | A1* | 9/2006 | Wu | A47G 25/1428 223/85 |
| 2007/0062984 | A1* | 3/2007 | Louw | A47G 25/1428 223/85 |
| 2007/0272716 | A1* | 11/2007 | Wu | A47G 25/1428 223/85 |
| 2011/0179681 | A1 | 7/2011 | Lamers | |
| 2015/0201782 | A1 | 7/2015 | Kirkwood | |
| 2016/0166098 | A1 | 6/2016 | Varghese-Abraham | |
| 2016/0270576 | A1* | 9/2016 | Kirkwood | A47G 25/1428 |

FOREIGN PATENT DOCUMENTS

| | | | |
|---|---|---|---|
| GB | 2399493 | A | 9/2004 |
| NL | 8801446 | A | 1/1990 |

* cited by examiner

CLOSET ORGANIZING DEVICE

BACKGROUND

Present invention embodiments are related to an apparatus, which can be slidably attached to a clothing hangar, to provide information with respect to clothes hanging on the clothing hanger and a grouping of clothing hanging contiguously with the clothing hangar. In particular, present invention embodiments relate to an apparatus that can be removably and slidably attached to a clothing hanger, wherein the apparatus further includes a tabular portion, with information thereon, such that the tabular portion and the information is visible when the hanger is placed in a hanging position in a closet.

One may have a difficult time locating particular items of clothing in a closet, particularly when the closet is crowded and disorganized. This problem is particularly annoying when one is in a rush and the particular items of clothing blend in with or are hidden by other apparel hanging in the closet. What is needed is a way to organize apparel in a closet such that particular items of clothing can be easily located.

SUMMARY

In a first aspect of various embodiments, a closet organizing device is provided. The closet organizing device includes a base, a first stabilizer, a second stabilizer, and a tabular portion. The base has an upper end, a lower, and a hole extending through a central portion of the upper end and the lower end for slidably receiving a hook portion of a clothing hanger. The first stabilizer and the second stabilizer extend from the lower end and are substantially perpendicular to a surface of the lower end. The first stabilizer and the second stabilizer are located equidistant from and on opposite sides of the hole. The first stabilizer and the second stabilizer are configured to fit over opposite sides of a hanger body. An edge portion extends along an outer surface of the base between the upper end and the lower end. The tabular portion extends outwardly from the edge portion, has a parallel front side and rear side parallel, and resides in a plane that is substantially aligned with a lengthwise direction of the hole.

In a second aspect of various embodiments, a second closet organizing device is provided. The second closet organizing device includes a base, a first stabilizer, a second stabilizer, and a tabular portion. The base has an upper end and a lower end and a hole extending through a central portion of the upper end and the lower end for slidably receiving a hook portion of a clothing hanger. The first stabilizer and the second stabilizer extend from the lower end and are substantially perpendicular to a surface of the lower end. The first stabilizer and the second stabilizer have front and rear sides which are substantially parallel to each other. The first stabilizer and the second stabilizer are located equidistant from and on opposite sides of the hole. The tabular portion extends from an edge portion of the base, which further extends along an outer surface between the upper end and the lower end. The tabular portion has parallel front rear sides and resides in a plane that is substantially parallel to a first plane in which the front side of the first stabilizer resides and a second plane in which the front side of the second stabilizer resides. The plane in which the tabular portion resides extends between the first plane and the second plane. The first stabilizer and the second stabilizer are configured to fit over opposite sides of a hanger body.

BRIEF DESCRIPTION OF THE DRAWINGS

Generally, like reference numerals in the various figures are utilized to designate like components.

DETAILED DESCRIPTION

Figure 1:
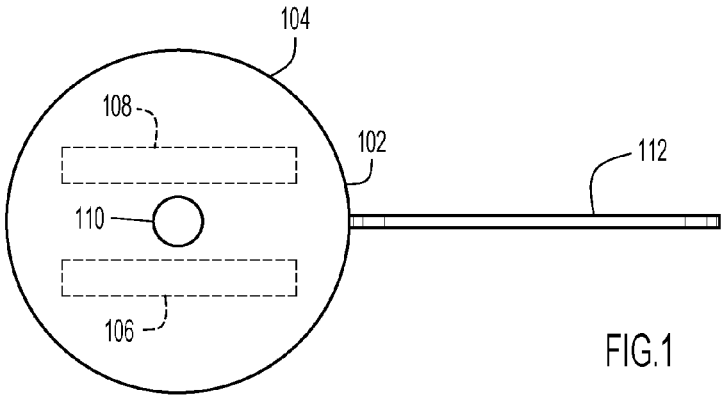
FIG. 1 illustrates a top view of a first embodiment of a closet organizing device.
Figure 2:
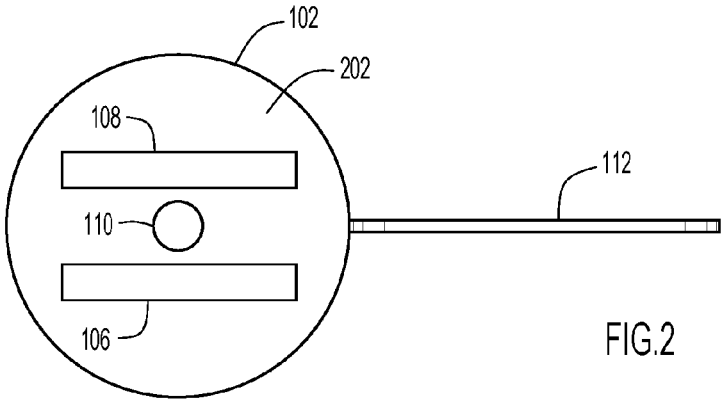
FIG. 2 illustrates a bottom view of the first embodiment of the closet organizing device.
Figure 3:
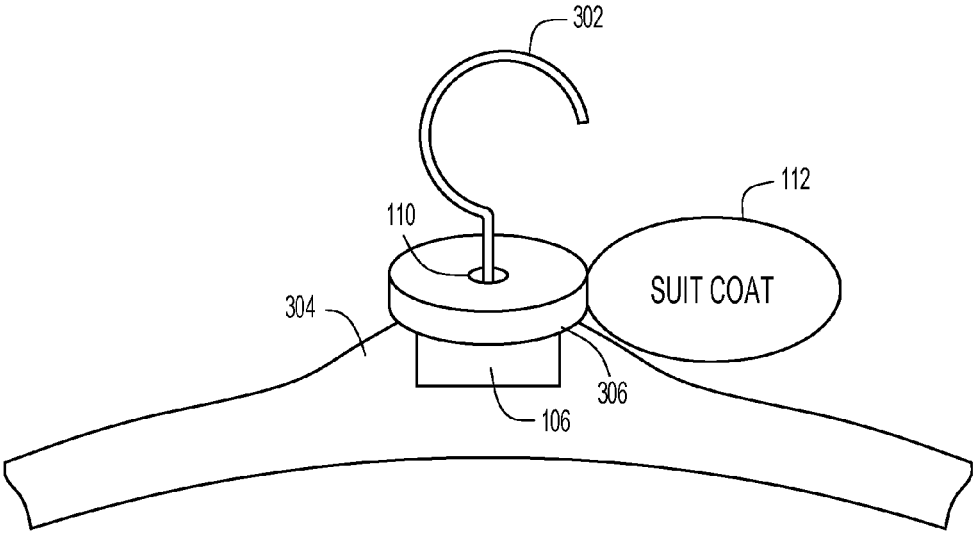
FIG. 3 illustrates a perspective view of the first embodiment of the closet organizing device.

FIGS. 1, 2 and 3, respectively, illustrate a top view, a bottom view, and a perspective view of a first embodiment of a closet organizing device. The closet organizing device has a base 102 with an upper end 104 and a lower end 202. A hole 110 is formed in base 102 extending from a central portion of upper end 104 to a central portion of lower end 202. Upper end 104 and lower end 202 may have a same shape. FIGS. 1 and 2 show upper end 104 and lower end 202 with a circular shape. In other embodiments, upper end 104 and lower end 202 may have other shapes including, but not limited to an oval shape, a square shape, a rectangular shape, a triangular shape, a polygonal shape or a shape having three or more sides. First and second stabilizers 106 and 108 may extend from and be substantially perpendicular to lower end 202 and may be equidistant from and on opposite sides of hole 110. In the embodiment of FIGS. 1-3, each side of the first and second stabilizers has a rectangular shape, although other embodiments may have other shapes. A tabular portion 112 may extend from an edge portion 306, which resides on an outer portion of base 102 between upper end 104 and lower end 202. Tabular portion 112 is parallel to a first side of the first stabilizer 106 and a first side of second stabilizer 108 and resides in a plane that passes through hole 110.

In FIG. 3, the closet organizing device is shown slidably attached to a clothing hanger. A hook portion 302 of the clothing hanger is slid through hole 110 such that first stabilizer 106 is adjacent to a front side of hanger body 304 and second stabilizer 108 is adjacent to a rear side of hanger body 304. Tabular portion 112 has an oval shape and extends outwardly from edge portion 306 and is substantially parallel with hanger body 304.

Figure 4:
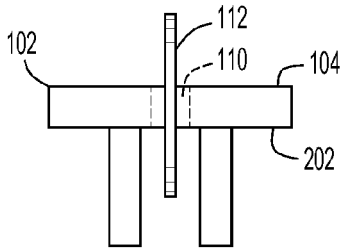
FIG. 4 illustrates a right side view of the first embodiment of the closet organizing device.

FIG. 4 shows a right side view of the first embodiment of the closet organizing device. As can be seen, tabular portion 112 resides in a plane that passes through a central portion of hole 110 and is substantially perpendicular to upper edge 104 and lower edge 202.

In a preferred embodiment, base 102 of the first embodiment has a diameter of 2 inches and a depth of 0.625 inches. Hole 110 has a diameter of 0.3125 inches. Tabular portion 112 extends outwardly 3.125 inches, has a height, at its tallest point, of 2 inches, and a thickness of 0.0625 inches. First and second stabilizers 106, 108 are 1 inch in height, 1.5 inches in width, and 0.375 inches thick. These measurements may vary in other embodiments.

Figure 5:
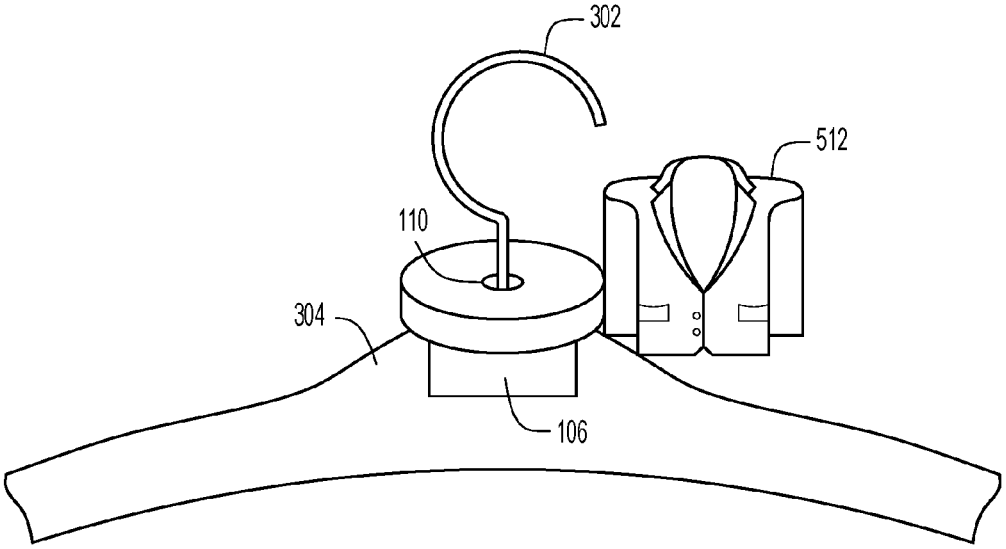
FIG. 5 illustrates a perspective view of a second embodiment of the closet organizing device.

FIG. 5 is a perspective view of a second embodiment of the closet organizing device. The second embodiment differs from the first embodiment such that a tabular portion 512 is shaped like an article of clothing. In FIG. 5, tabular portion 512 is shaped like a sport coat, but could be shaped like other articles of clothing in other embodiments.

Figure 6:
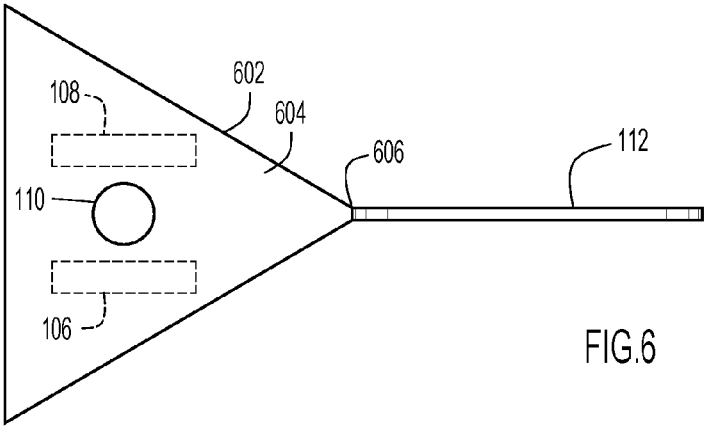
FIG. 6 illustrates a top view of a third embodiment of the closet organizing device.
Figure 7:
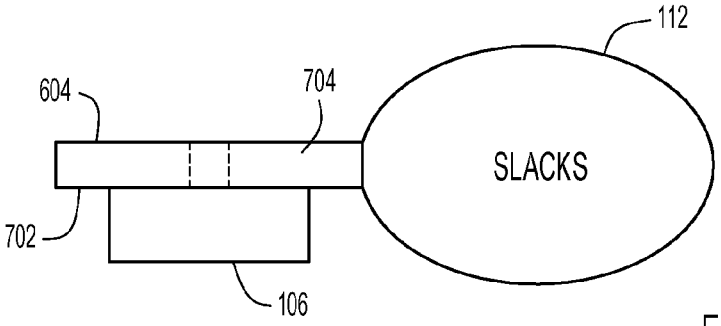
FIG. 7 illustrates a front view of the third embodiment of the closet organizing device.

FIGS. 6 and 7 illustrate a top view and a front view, respectively, of a third embodiment of the closet organizing device. In this embodiment, a base 602 has an upper end 604 and a lower end 702 with a same triangular shape. Base 602 has a hole 110 formed through a central portion of upper end 604 extending through base 602 to a central portion of lower end 702. An edge portion 704 extends along an outer surface of base 602 between upper end 604 and the lower end 702. Tabular portion 112 extends outward from the edge at a vertex 606 of an angle, as seen in the top view, such that tabular portion 112 resides in a plane that extends through hole 110. First stabilizer 106 and second stabilizer 108 are parallel to each other and equidistant from hole 110 on opposite sides thereof. This embodiment differs from the first embodiment in that upper end 604 and the lower end 702 have a triangular shape.

Figure 8:
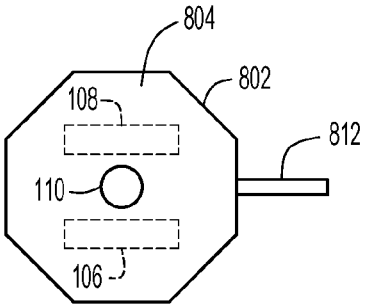
FIG. 8 illustrates a top view of a fourth embodiment of the closet organizing device.
Figure 9:
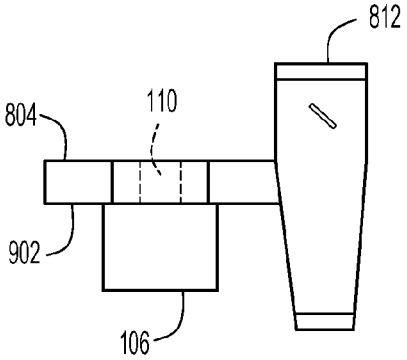
FIG. 9 illustrates a front view of the fourth embodiment of the closet organizing device.

FIGS. 8 and 9 illustrate, respectively, a top view and a front view of a fourth embodiment of the closet organizing device. A base 802 has an upper end 804 and a lower end (not shown) with a same octagonal shape. Hole 110 extends through a central portion of upper end 804 to a central portion of the lower end. As in previous embodiments, first stabilizer 106 and second stabilizer 108 are equidistant from and on opposite sides of hole 110. Tabular portion 812 extends outwardly from an edge, formed between upper end 804 and the lower end, and resides in a plane that extends through a central portion of hole 110 and is substantially perpendicular to upper end 804 and lower edge 902. Tabular portion 812 is shaped like an article of clothing. In FIG. 9, tabular portion 812 is shaped like a pair of slacks.

Figure 10:
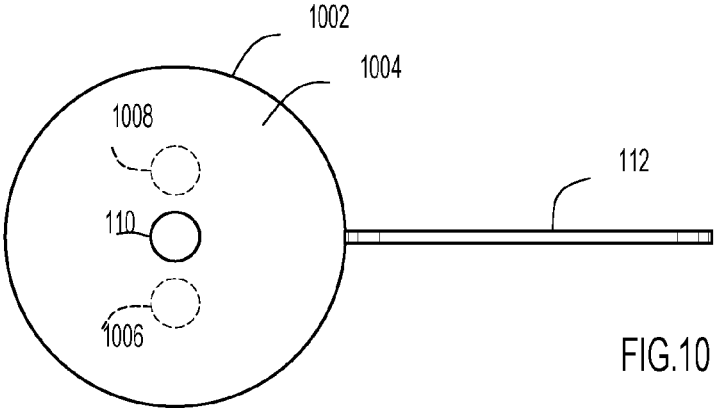
FIG. 10 illustrates a top view of a fifth embodiment of the closet organizing device.
Figure 11:
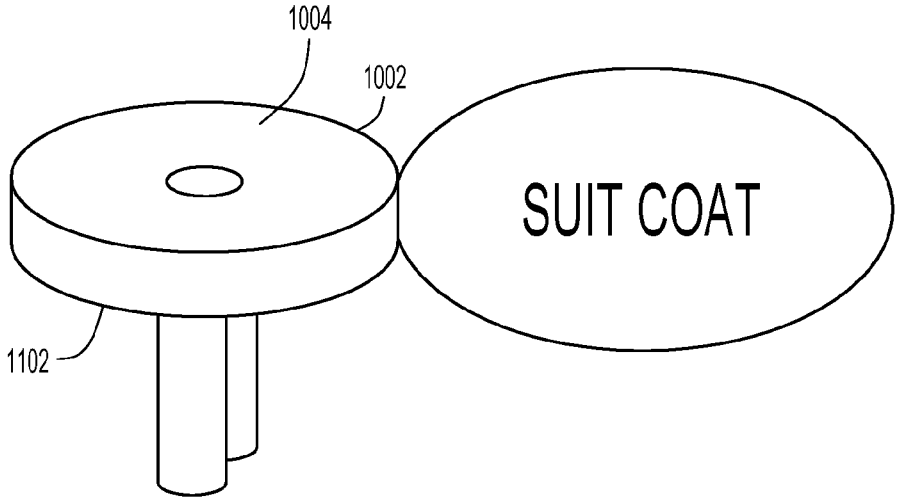
FIG. 11 illustrates a perspective view of the fifth embodiment of the closet organizing device.

FIGS. 10 and 11, respectively, show a top view and a perspective view of a fifth embodiment having a base 1002 with a circular upper end 1004 and lower end 1102. Tabular portion 112 may have an oval shape as in the first embodiment. Also, as in the first embodiment, tabular portion 112 extends outwardly from an edge of base 102 such that a plane in which tabular portion 112 resides extends through a central portion of hole 110. This embodiment differs from the first embodiment such that a first stabilizer 1006 and a second stabilizer 1008 have cylindrical shapes and are equidistant from and on opposite sides of hole 110. When attached to a clothing hanger, first stabilizer 1006 and second stabilizer 1008 are on opposite sides of a hanger body. In some embodiments, first and second stabilizers 1004, 1006 may have a same diameter as hole 110.

Features of various embodiments may be mixed with features of other embodiments. For example, base 102 of the first embodiment may have tabular portion 812 extending outwardly therefrom. Similarly, any of the first through fourth embodiments may have cylindrical first and second stabilizers 1006, 1008 as shown in FIGS. 10 and 11. Further, the tabular portions in any of the embodiments may have any of a variety of shapes including, but not limited to a circular shape, a square, a rectangle, a triangle, and a diamond shape.

The closet organizing device may be constructed from one or more materials or combinations of materials including, but limited to, wood, plastic, fiberglass, metal, and composite materials. The tabular portion may have information thereon. In some embodiments, the information may describe a type of clothing. In other embodiments, the information may include, but not be limited to, a day of the week, an indication of clean or dirty, as well as other types of information. In some other embodiments, the tabular portion may be shaped like an article of clothing including, but not limited to, a dress, a shirt, a blouse, a necktie, slacks, a suit and a jersey.

The present invention may be embodied in other specific forms without departing from the spirit or essential attributes thereof. It is therefore desired that the present embodiments be considered in all respects as illustrative and not restrictive.

We claim as our invention:

1. A closet organizing device comprising:

a base having an upper end and a lower end and forming a hole extending through a central portion of the upper end and the lower end for slidably receiving a hook portion of a clothing hangar;

a first stabilizer and a second stabilizer extending from the lower end and being perpendicular to a surface of the lower end, the first stabilizer and the second stabilizer being located equidistant from and on opposite sides of the hole and extending along respective portions of the lower end such that respective ends of each of the first stabilizer and the second stabilizer do not abut an edge of the lower end, the first stabilizer and the second stabilizer being configured to fit over opposite sides of a hanger body, each of the first stabilizer and the second stabilizer have a respective front side and a respective rear side parallel to each other, and the front side and the rear side of the first stabilizer are parallel to the front side and the rear side of the second stabilizer; and a tabular portion extending from an edge portion of the base, the edge portion extending along an outer surface of the base between the upper end and the lower end, the tabular portion extending outwardly from the edge portion, the tabular portion having a front side and a rear side parallel to each other and residing in a plane that is substantially aligned with a lengthwise direction of the hole.

2. The closet organizing device of claim 1, wherein the upper end and the lower end of the base have circular shapes or oval shapes.

3. The closet organizing device of claim 1, wherein the upper end and the lower end of the base have a triangular shape.

4. The closet organizing device of claim 1, wherein the upper end and the lower end of the base have a polygonal shape.

5. The closet organizing device of claim 1, wherein the upper end and the lower end of the base have a same shape.

6. The closet organizing device of claim 1, wherein the tabular portion is shaped like an article of clothing.

7. The closet organizing device of claim 1, wherein the tabular portion is substantially oval in shape.

8. The closet organizing device of claim 1, wherein at least one of the front side and the rear side of the tabular portion has information thereon.

9. A closet organizing device comprising:

a base having an upper end and a lower end and forming a hole extending through a central portion of the upper end and the lower end for slidably receiving a hook portion of a clothing hangar;

a first stabilizer and a second stabilizer extending from the lower end and being perpendicular to a surface of the lower end, the first stabilizer and the second stabilizer having front and rear sides, the front and rear sides of the first stabilizer and the second stabilizer being substantially parallel to each other, and the first stabilizer and the second stabilizer being located equidistant from and on opposite sides of the hole and extending along respective portions of the lower end such that respective ends of each of the first stabilizer and the second stabilizer do not abut an edge of the lower end; and a tabular portion extending from an edge portion of the base, the edge portion extending along an outer surface of the base between the upper end and the lower end, the tabular portion extending outwardly from the edge portion, the tabular portion having a front side and a rear side parallel to each other and residing in a plane that is substantially parallel to a first plane in which the front side of the first stabilizer resides and a second plane in which the front side of the second stabilizer resides, the plane in which the tabular portion resides extending between the first plane and the second plane, the first stabilizer and the second stabilizer being configured to fit over opposite sides of a hanger body.

10. The closet organizing device of claim 9, wherein the upper end and the lower end have a same shape.

11. The closet organizing device of claim 10, wherein the upper end and the lower end of the base have circular shapes or oval shapes.

12. The closet organizing device of claim 10, wherein the upper end and the lower end of the base have a shape with at least four sides.

13. The closet organizing device of claim 10, wherein the upper end and the lower end have a shape with at least three sides.

14. The closet organizing device of claim 9, wherein the tabular portion has a substantially oval or circular shape.

15. The closet organizing device of claim of claim 9, wherein the tabular portion is shaped like an article of clothing.

16. The closet organizing device of claim 9, wherein at least one of the front side and the rear side of the tabular portion has information thereon.

* * * * *